United States Patent [19]

Nitta

[11] Patent Number: 4,878,833

[45] Date of Patent: Nov. 7, 1989

[54] GASLIGHTER STRUCTURE

[75] Inventor: Tomio Nitta, Yokohama, Japan

[73] Assignee: Tokai Corporation, Yokohama, Japan

[21] Appl. No.: 344,725

[22] Filed: Apr. 28, 1989

[30] Foreign Application Priority Data

May 11, 1988 [JP] Japan ..... 63-61048[U]

[51] Int. Cl.[4] ..... F23Q 25/00

[52] U.S. Cl. ..... 431/146; 431/144; 431/152

[58] Field of Search ..... 431/135, 129, 146, 152, 431/144, 264, 274, 277, 273; 206/242

[56] References Cited

U.S. PATENT DOCUMENTS 2,517,191 8/1950 Flickinger et al. ..... 431/152 X 4,181,490 1/1980 Nitta ..... 431/152

FOREIGN PATENT DOCUMENTS 930249. 1/1948 France ..... 431/152

*Primary Examiner*—Randall L. Green

*Attorney, Agent, or Firm*—Armstrong, Nikaido Marmelstein, Kubovcik & Murray

[57] ABSTRACT

Disclosed is an improved gaslighter structure which has a detachable support piece to be fitted in the cap and the housing for pivotally fixing the cap to the housing. This arrangement permits complete pivotal connection of the cap to the housing simply by thrusting the upper extension of the support piece into the rear end space of the cap and by thrusting the lower end of the support piece into the rear top inside of the housing until its opposite pivot pins are fitted in the counter sinks on the rear top inside of the housing.

1 Claim, 3 Drawing Sheets

FIG. 4A
PRIOR ART
FIG. 4B
PRIOR ART
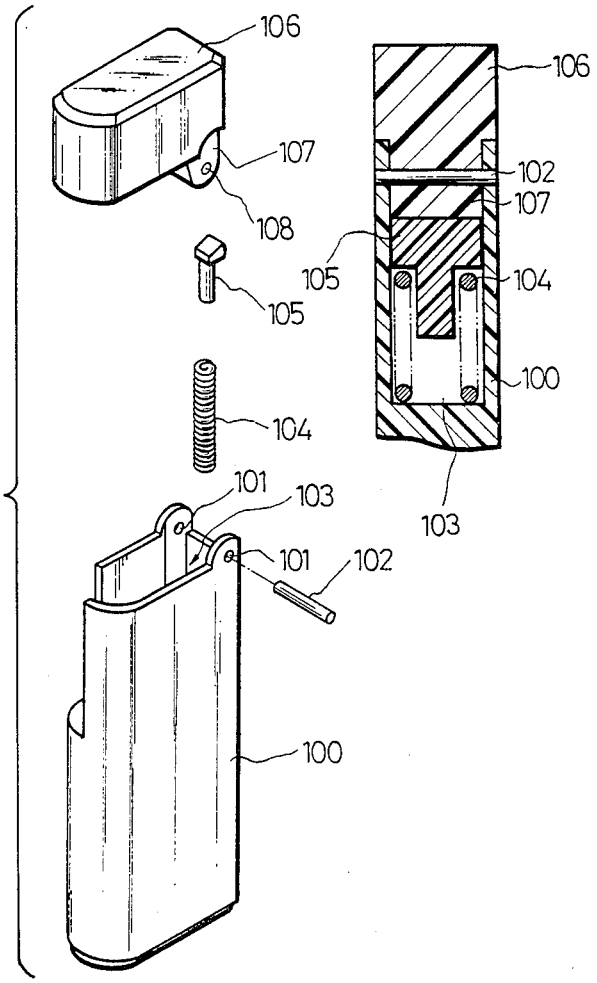
FIG. 3B
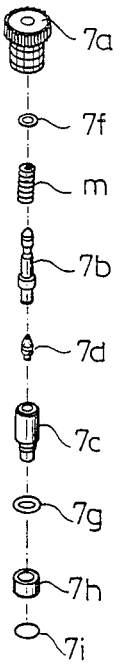

GASLIGHTER STRUCTURE

BACKGROUND OF THE INVENTION

1. Field of the Invention

The present invention relates to a gaslighter equipped with a cap pivot latch which permits a cap to snap into its open or closed position, particularly to an improved gas lighter structure which permits the cap and the housing to be assembled with ease.

2. Related Art

In general, a gaslighter is composed of many small parts. Gaslighters show a tendency to reduce their size and weight. Accordingly, the size of parts have been reduced by degrees. The lighter housing and cap are connected by inserting a pivot pin in aligned apertures of the cap and housing.

FIG. 4 shows a conventional gaslighter having its cap and housing connected by a pin. It uses a "T"-shaped push rod 105 with a spring 104 around its leg. The combination of the push rod 105 and the spring 104 is inserted in the longitudinal space 103 on the rear side of a housing 100 until the spring 104 reaches the bottom of the longitudinal space 103. Thus, the push rod 105 is resiliently held so as to move vertically in the longitudinal space 103. Then, the support piece 107 of a cap 106 is inserted in the longitudinal space 103 to push down the push rod 105 until the through aperture 108 of the support piece 107 is put in alignment with the through apertures 101 of the opposite rear, top extensions of the housing 100. Then, a pivot pin 102 is inserted in these aligned apertures 101 and 108. Thus, the cap 106 is pivotally fixed to the housing 100.

The attachment of the cap to the housing with a pin requires insertion of the pin in aligned apertures of the cap and the housing. This requires time consuming work, and accordingly, the efficiency with which the gaslighter is assembled is lowered.

Alternatively, a cap has opposite pivot pins integrally connected to its rear lower projection, and the cap is connected to the housing by fitting the opposite pivot pins in the countersinks of the housing. The integration of pivots onto the cap, however, requires complicated molds, which are relatively expensive.

SUMMARY OF THE INVENTION

In view of the above one object of the present invention is to provide a gaslighter structure which permits necessary parts to be assembled with ease, accordingly improving the efficiency with gaslighters are made.

To attain this object a gaslighter which comprises: a lighter body comprising a housing having a built-in gas container to be filled with a liquefied petroleum gas, a nozzle assembly fixed to the top plate of said housing and cap pivot latch provided to the rear, top of said housing: a flint unit comprising a mount having a cover fitted thereon, said cover having a flame aperture made in its front, a flint mechanism in the vicinity of said flame aperture and a conduit opening at its front end in the vicinity of said flame aperture, extending under said mount and connected at its rear end to said nozzle assembly; and a cap having a support piece at its rear end, said cap being fixed at said cap pivot latch to permit said cap to turn about its pivot and cover said flint unit when closed, is improved according to the present invention in that said support piece comprises a generally rectangular synthetic resin mold having pivots integrally fixed to its lower opposite sides, said support piece having its upper end push-fitted into the rear end space of said cap, and said support piece having its pivots fitted in countersinks of the rear top inside of said housing.

This arrangement permits complete pivotal connection of the cap to the housing simply by thrusting the upper end of the support piece into the rear end space of the cap and by thrusting the lower end of the support piece into the rear top inside of the housing until its opposite pivot pins are fitted in the countersinks on the rear top inside of the housing.

Other objects and advantages of the present invention will be understood from the following description of a gaslighter according to one preferred embodiment of the present invention, which is shown in the accompanying drawings:

BRIEF DESCRIPTION OF THE DRAWINGS

FIG. 3A is an exploded view of the gaslighter whereas FIG. 3B is an exploded view of a nozzle assembly; and FIG. 4A is an exploded view of a conventional gaslighter whereas FIG. 4B is a longitudinal section of the cap pivot latch.

PREFERRED EMBODIMENT OF THE INVENTION

Figure 1:
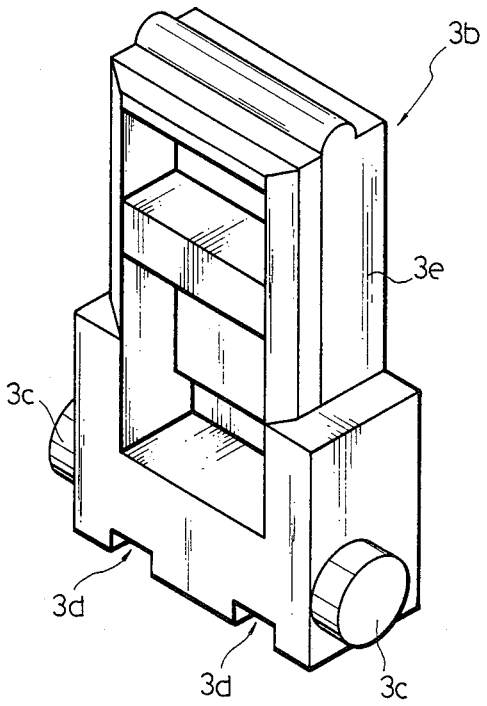
FIG. 1 is an enlarged perspective view of a support piece which is used in pivotally connecting the cap to the housing of a gaslighter according to the present invention.
Figure 2:
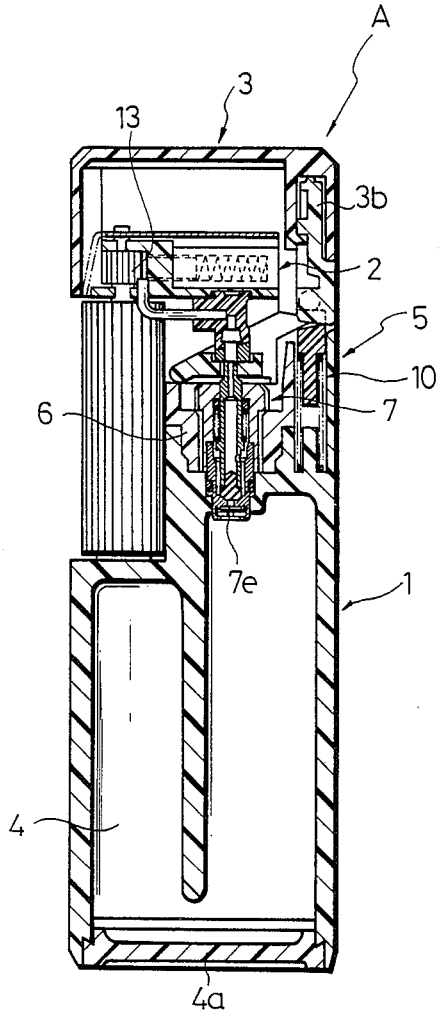
FIG. 2 is a longitudinal section of the gaslighter according to the present invention.

FIG. 2 shows a gaslighter A according to one embodiment of the present invention as comprising a lighter body 1, a flint unit 2 and a cap 3. The lighter body 1 is of a synthetic resin mold, comprising a gas container 4 to be filled with a liquefied petroleum gas, a nozzle assembly 7 fixed to the top plate 6 of the housing and a cap pivot latch 5 provided to the rear, top of the housing. The housing 1 has a bottom plate 4*a*.

Figure 3A:
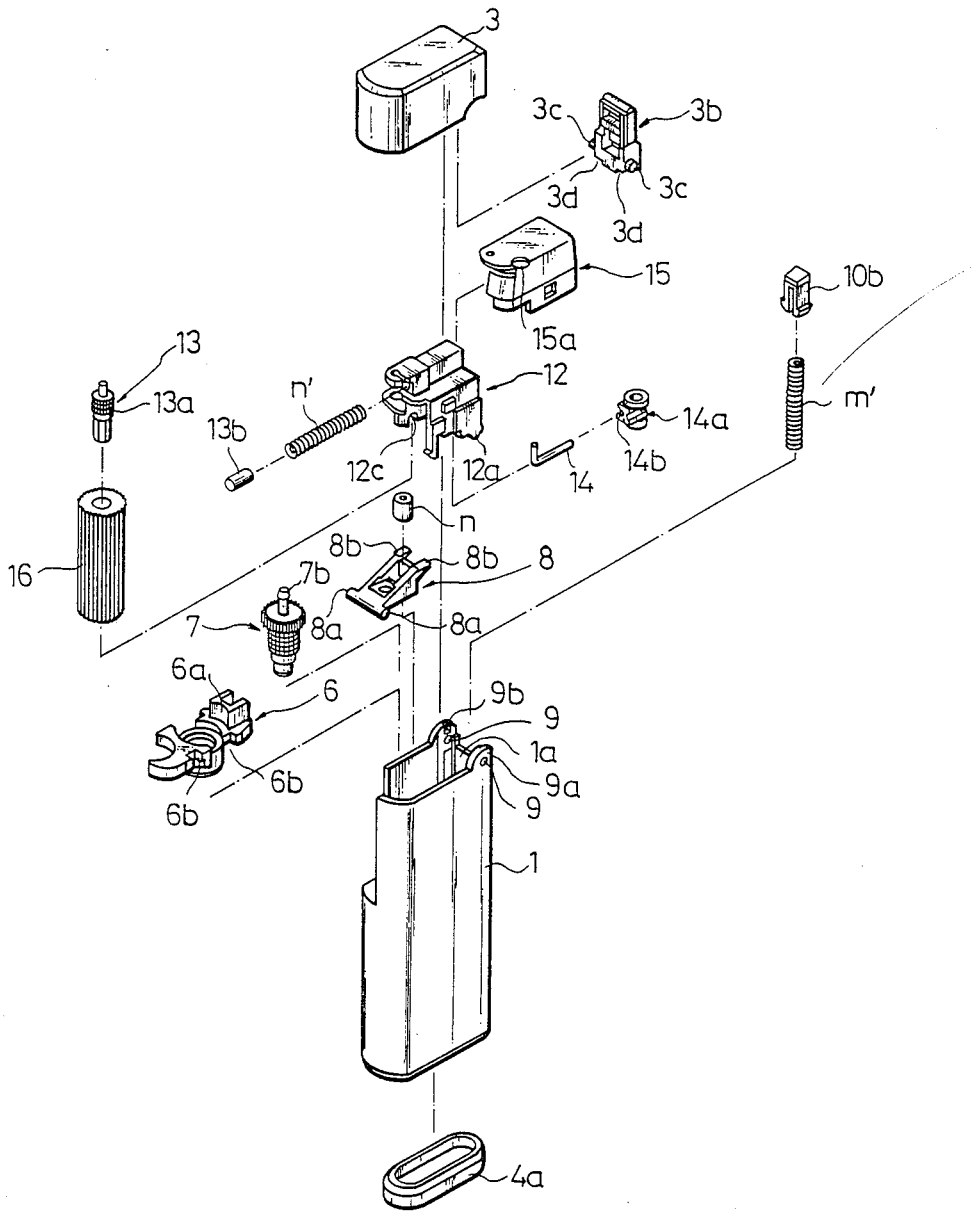

As best shown in FIG. 3B, the nozzle assembly 7 comprises an outer casing 7*a*, a tapped O-ring 7*f*, a spring m, a gas ejection pipe 7*b*, a rubber plug 7*d*, an inner cylinder 7*c*, an O-ring 7*g*, a thermal adhesion pipe 7*h* and a filter 7*i*. The gas ejection pipe 7*b* is movably fitted in the outer casing 7*a* and partly appearing above the outer casing 7*a*. The nozzle assembly 7 is fixed to the top plate 6. Its outer casing 7*a* is threadedly engaged with the tapped aperture of the top plate 6, and its inner cylinder 7*c* communicates with the inside of the gas container 4. The gas ejection pipe 7*b* is biased downwards by the spring (m) to keep the rubber plug 7*d* closing the bottom aperture 7*e* of the inner cylinder 7*c*.

A lever 8 looks like a gun carriage. It has two pivot pins 8*a* integrally connected to the opposite sides of its front end, two engagement pieces 8*b* integrally connected to its rear, upper end, and an aperture in its bottom. The top end of the ejection nozzle 7*b* is inserted in the aperture of the lever 8, and is fixed to the lever 8 by a rubber ring (n).

A cap pivot latch 5 is provided to the rear, top of the housing. The housing has two opposing a elongations 9*a* integrally connected to its rear, top portion. Each elongation, somewhat flexible, has a through aperture 9 and a notch 9*b* inside. Each notch extends from the top end of the elongation, and it reaches short of the aperture 9. The support piece 3*b* is push-fitted into the rear space of the cap 3, and then the support piece 3b is pivotally fixed to the rear elongations 9a as later described.

The cap pivot latch 5 comprises a push rod 10b and an associated spring (m') in the hollow cylinder space 10 which is defined by the inner wall 1a of the rear portion of the housing and the rear wall 6a of the top plate 6. The push rod 10b is generally in the form of the letter "E", comprising a central leg and two opposite side legs and a horizontal base having an inclined top, all legs being integrally connected to the horizontal base. Each side leg has a hook integrally connected to its side, and the spring (m') is loosely fitted around the central leg. The push rod 10b is spring-biased upwards to push itself against the support piece 3b of the cap 3, thereby permitting the cap 3 to click shut and open.

The flint unit 2 comprises a mount 12 having a cover 15 fitted thereon, a flint mechanism 13 arranged in the vicinity of the flame aperture 15a of the cover 15, and a conduit 14 opening at its front end in the vicinity of the flame aperture 15a, extending under the amount 12 and connected at its rear end to the gas ejection pipe 7b of the nozzle assembly 7 via a connecting piece 14a.

The mount 12 is a synthetic resin mold having a generally "U"-shape. It has three hooks 12a on its lower edge. It is fixed to the top plate 6 with its hooks 12a caught by the notches 6b of the top plate 6.

The mount 12 has two semicircular recesses 12b on its lower front edge. The lever 8 is rotatably fixed to the mount 12 with its pivot pins 8a in the semicircular recesses 12b of the mount 12. The ejection nozzle 7b is fixed to the lever 8 as described earlier. When the lever 8 is pushed down to rotate about its pivot 8a, the ejection nozzle 7b is raised to permit ejection of gas from the nozzle point. The cover 15 is put on the mount 12 with its flame aperture 15a close to the front end of the L-shaped conduit 14. The rear end of the conduit 14 is inserted in the through hole 14b of the connector metal 14a, and the tip end of the ejection nozzle 7b is inserted in the through hole 14b.

The flint mechanism 13 comprises a flint wheel 13a and a flint 13b. The flint wheel 13a is located in the vicinity of the flame aperture 15a of the cover 15. The flint 13b is biased by a spring (n') to be pushed against the flint wheel 13a all the time.

A rotatable cylinder 16 is connected to the flint wheel 13a. Rotation of the rotatable cylinder 16 causes the flint wheel 13a to rotate for striking fire, thereby igniting the tip end of the conduit 14 when the gas ejects.

The flint unit 2 is made up by the mount 12 with its cover 15 put thereon, the flint mechanism located in the vicinity of the flame aperture 15a of the cover 15 and the conduit 14 opening at its front end in the vicinity of the flame aperture 15a, and extending under the mount 12. The flint unit 2 is push-fitted in the top space of the housing unitl the hooks 12a of the mount 12 are caught by the notches 6b of the top plate 6. At the same time, a pin standing upright on the shoulder of the housing is loosely inserted in the countersink made in the bottom of the rotatable cylinder 16. Thus, the rotatable cylinder 16 is rotatably fixed to the gaslighter body 1.

The upper elongation 3e of the support piece 3b is pushfitted and fixed to the rear side of the cap 3 as best seen in FIG. 2. The opposite projections 3c of the support piece 3b are inserted in the slots 9b of the rear elongations 9a of the housing 1. The rear elongations 9a will be yieldingly bent outwards to allow the pivot axles 3c to go to and fall in the apertures 9 of the rear elongations 9a. Then, the bottom of the support piece 3b sits on the inclined top of the push rod 10b. Thus, the cap 3 is pivotally fixed to the housing.

The support piece 3b has engagement notches 3d on its bottom to catch the rear extensions 8b of the lever 8 for turning the lever 8 when the cap 3 opens.

As described above, a gaslighter according to the present invention has a detachable support piece to be fitted in the cap and the housing for pivotally fixing the cap to the housing. This arrangement permits complete pivotal connection of the cap to the housing simply by thrusting the upper extension of the support piece into the rear end space of the cap and by thrusting the lower end of the support piece into the rear top inside of the housing until its opposite pivot pins are fitted in the counter sinks on the rear top inside of the housing. This contributes the improvement of the assembling efficiency.

I claim:

1. A gaslighter which comprises: a lighter body comprising a housing having a built-in gas container to be filled with a liquefied petroleum gas, a nozzle fixed to a top plate of said housing and a cap pivot latch provided to the rear top of said housing: a flint unit comprising a mount having a cover fitted thereon, said cover having a flame aperture made in its front, a flint mechanism in the vicinity of said flame aperture and a conduit opening at its front end in the vicinity of said flame aperture, extending under said mount and connected at its rear end to said nozzle assembly; and a cap having a support piece at its rear end, said cap being fixed to said cap pivot latch to permit said cap to turn about its pivot and cover said flint unit when closed, characterized in that said support piece comprises a generally rectangular synthetic resin mold having pivots integrally fixed to its lower opposite sides, said support piece having its upper end push-fitted into the rear end space of said cap, and said support piece having its pivots fitted in countersinks of the rear top inside of said housing.

* * * * *